US007775296B2

(12) United States Patent
Webber

(10) Patent No.: US 7,775,296 B2
(45) Date of Patent: Aug. 17, 2010

(54) GROUND STABILIZED TRANSPORTABLE DROP HAMMER

(75) Inventor: Patrick H. Webber, Jasper, GA (US)

(73) Assignee: The Stanley Works, New Britain, CT (US)

( * ) Notice: Subject to any disclaimer, the term of this patent is extended or adjusted under 35 U.S.C. 154(b) by 131 days.

(21) Appl. No.: 11/900,729

(22) Filed: Sep. 13, 2007

(65) Prior Publication Data

US 2008/0066938 A1 Mar. 20, 2008

Related U.S. Application Data

(60) Provisional application No. 60/845,412, filed on Sep. 18, 2006.

(51) Int. Cl.
*B25D 17/28* (2006.01)

(52) U.S. Cl. ..... 173/210; 173/162.1

(58) Field of Classification Search ..... 173/210, 173/162.1, 162.2; 267/137
See application file for complete search history.

(56) References Cited

U.S. PATENT DOCUMENTS 2,298,845 A * 10/1942 Schmied ..... 173/120
3,321,033 A * 5/1967 Benuska et al. ..... 173/204
3,565,351 A * 2/1971 Thorvald et al. ..... 241/99
4,852,661 A 8/1989 Ellington
5,095,600 A * 3/1992 Allan ..... 29/81.16
5,363,835 A * 11/1994 Robson ..... 125/40
5,393,127 A 2/1995 Kimball
7,331,405 B2 * 2/2008 Robson ..... 173/147
2005/0189128 A1 9/2005 Vought

* cited by examiner

*Primary Examiner*—Sunil Singh
(74) *Attorney, Agent, or Firm*—Mueller Smith & Okuley, LLC

(57) ABSTRACT

An improved portable, ground stabilized, drop hammer assembly for impacting a ground surface and adapted to be removably coupled to a driven host transport apparatus is composed of a drop weight, a frame including a sidewall, bottom plate and a host transport apparatus engagement assembly, and a power assembly for vertically reciprocatingly moving the drop weight to impact the ground surface. A shock absorbing element is carried either the frame assembly close to the ground surface or by the drop weight at its end close to the ground. Such shock absorbing material absorbs any movement by the drop weight into the frame assembly close to the ground surface to prevent damage to the frame assembly.

20 Claims, 4 Drawing Sheets

GROUND STABILIZED TRANSPORTABLE DROP HAMMER

CROSS-REFERENCE TO RELATED APPLICATIONS

This application claims benefit of provisional application Ser. No. 60/845,412 filed on Sep. 18, 2006, the disclosure of which is expressly incorporated herein by reference.

STATEMENT REGARDING FEDERALLY SPONSORED RESEARCH

Not applicable.

BACKGROUND

The present apparatus relates to construction equipment and more particularly to an easily transportable machine for breaking up paving material by a single operator.

The use of concrete breakers and the like with a variety of construction equipment, including skid steers and excavating equipment, is well known in the art. However, concrete breakers attached to hydraulically powered vehicles heretofore have typically comprised one of two types; a hydraulically driven vibrating bit, commonly referred to as a jack hammer, such as disclosed in U.S. Pat. No. 4,243,107, issued to Shook, and a gravity powered drop hammer utilizing a pivoting swing arm mounted on the lift arms of the equipment, as disclosed in U.S. Pat. No. 5,234,282, issued to Osborn.

Likewise, transportable, gravity powered drop hammers for breaking concrete and asphalt pavement also are known. Such apparatus are shown in U.S. Pat. No. 2,659,583, issued to Dorkins, and U.S. Pat. No. 4,852,661 issued to Ellington. Such portable devices are typically towed to a location and then operated manually by repeated raising and dropping a weight upon the groundwork surface. When the desired amount of concrete breaking has occurred, the drop hammer carrier is moved or otherwise towed to the next work location.

An improved transportable drop hammer is disclosed in U.S. Pat. No. 5,490,740, which discloses a ground-stabilized, portable drop hammer assembly that is highly maneuverable, faster, easily adaptable to existing construction equipment and which can be operated in an efficient manner by a single operator. A commercial drop hammer concrete breaker manufactured under U.S. Pat. No. 5,490,740 is a CYCLONE™ concrete breaker (Universal Impact Technologies, Inc., Jasper, Ga.). A similar design concrete hammer is a BOBCAT® drop hammer attachment (Ingersoll Rand, West Fargo, N. Dak.). Both of these commercial drop hammers exhibit the same problem during use. When the drop hammer (or drop weight) is dropped multiple times on the same area of concrete, the created concrete chunks accumulate underneath the drop hammer causing the drop hammer to be displaced into and contact the inside of the aperture plate or base, eventually causing it damage. The present disclosure is addressed to solving such problem.

SUMMARY

An improved portable, ground stabilized, drop hammer assembly for impacting a ground surface and adapted to be removably coupled to a driven host transport apparatus is composed of a drop weight, a host transport apparatus engagement assembly, a support assembly supporting the drop weight, and a power assembly for vertically reciprocatingly moving the drop weight to impact the ground surface. A shock absorbing element is carried either the support assembly close to the ground surface or by the drop weight at its end close to the ground. Such shock absorbing material absorbs any movement by the drop weight into the support assembly close to the ground surface to prevent damage to the support assembly The disclosure, accordingly, comprises the apparatus and method possessing the construction, combination of elements, and arrangement of parts and steps, which are exemplified in the following detailed description. Reference to that description and to the accompanying drawings should be had for a fuller understanding and appreciation of the nature and objects of the disclosure, although other objects may be obvious to those skilled in the art.

BRIEF DESCRIPTION OF THE DRAWINGS

For a fuller understanding of the nature and objects of the disclosure, reference should be had to the following detailed description taken in connection with the accompanying drawings wherein.

The drawings will be described further in connection with the following Detailed description.

DETAILED DESCRIPTION

Figure 1:
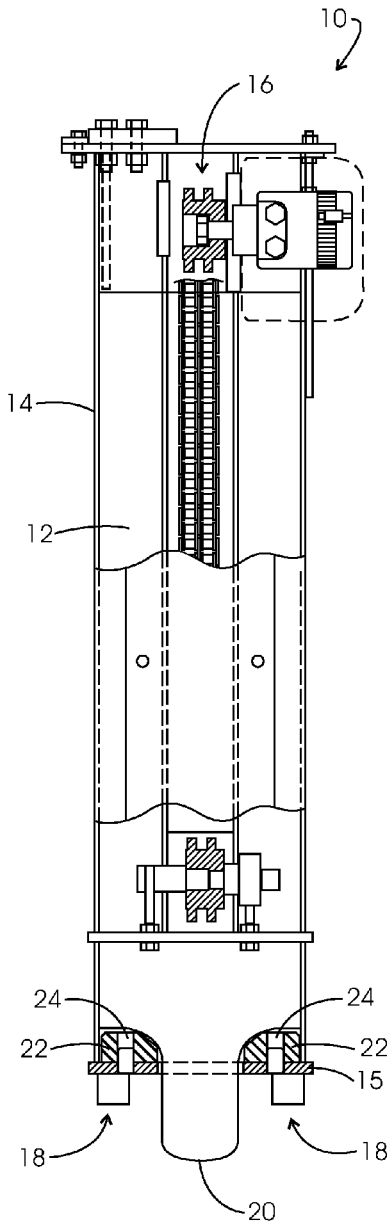
FIG. 1 is a front cross-sectional elevational view of the portable, ground stabilized, drop hammer assembly having the shock absorbing element affixed to the lower end of the support assembly.
Figure 2:
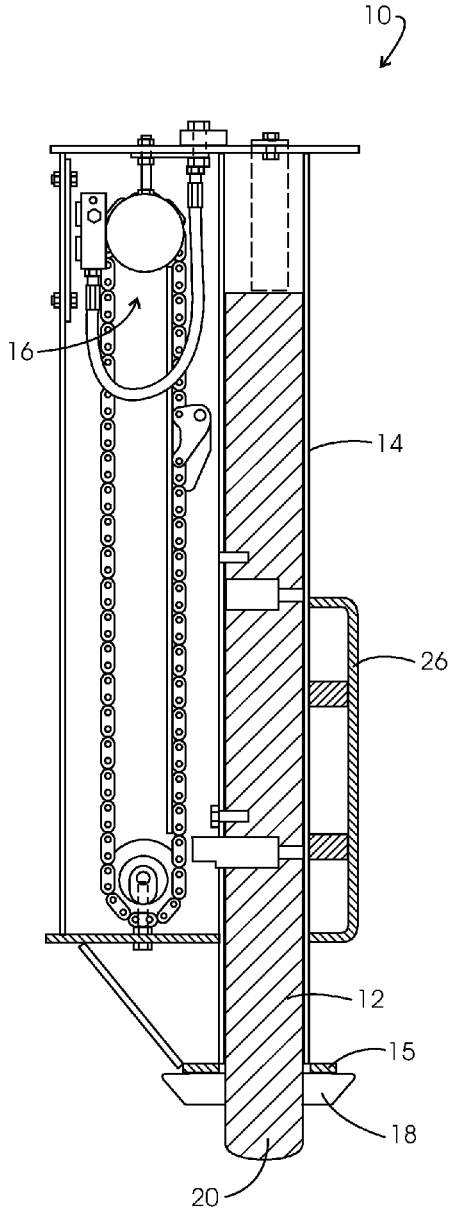
FIG. 2 is a side cross-sectional elevational view of the portable, ground stabilized, drop hammer assembly of FIG. 1.

Referring now to the drawings, wherein like reference numerals designate identical or corresponding components throughout the several views, FIGS. 1 and 2 show a transportable drop hammer assembly, 10, along with its component parts. It will be appreciated that embodiment illustrated in the drawings and the components parts shown in the drawings merely are illustrative and not limitative of the apparatus disclosed. The major sub-assemblies of drop hammer assembly 10 are a drop weight, 12, a frame assembly, 14, a ground plate, 15, and a power assembly, 16, for vertically reciprocatingly moving said drop weight to impact a ground surface, such as, for example, a concrete pad.

Figure 3:
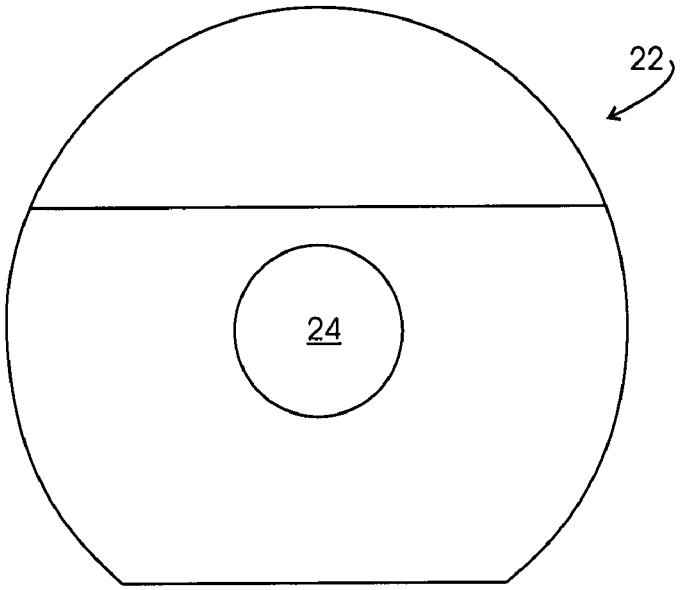
FIG. 3 is plan view of the shock-absorbing element depicted in FIG. 1.
Figure 4:
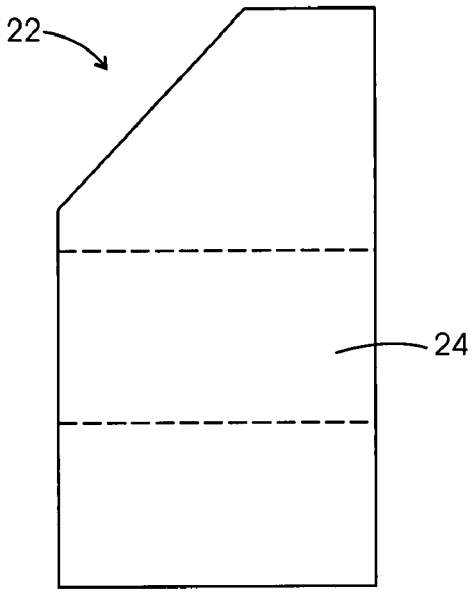
FIG. 4 is a side view of the shock-absorbing element of FIG. 3.
Figure 7:
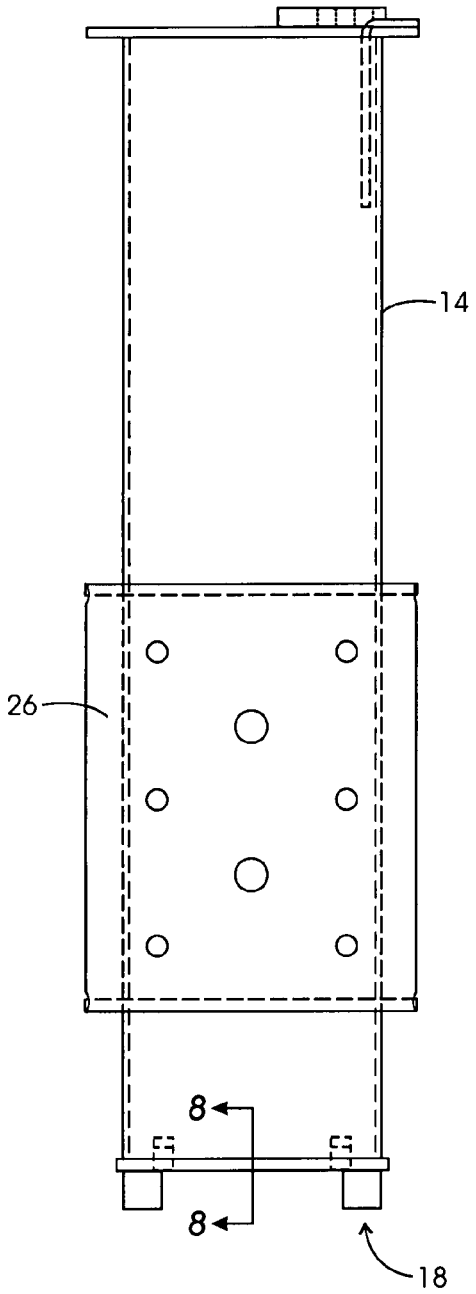
FIG. 7 is a front elevational view of the support assembly.
Figure 8:
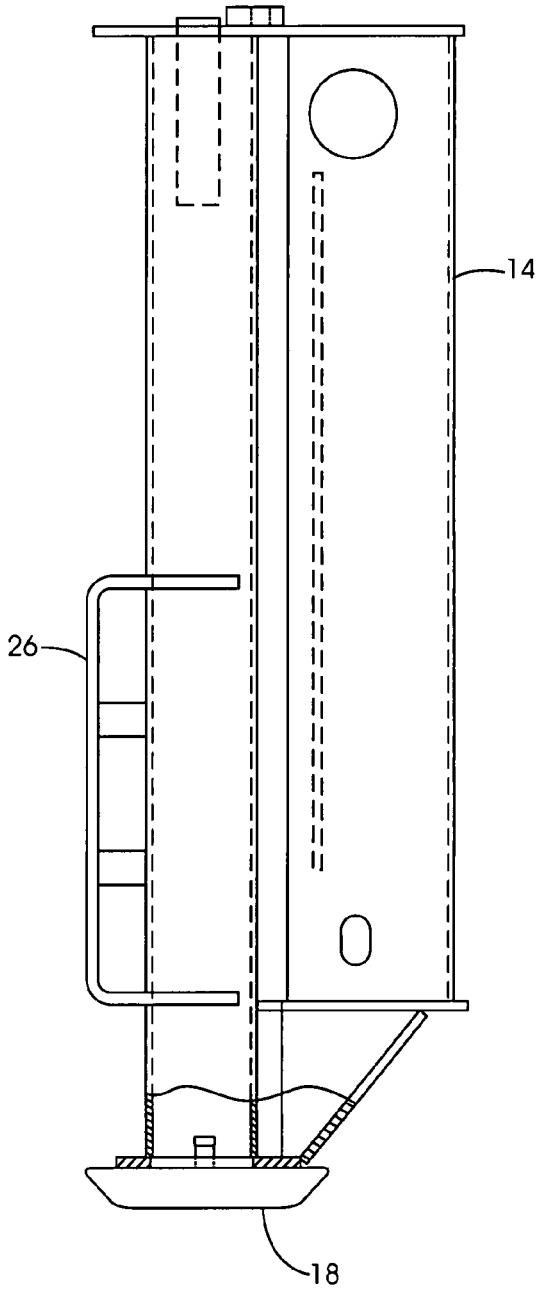
FIG. 8 is a sectional view taken along line 8-8 of FIG. 7.

Frame assembly 14 (see FIGS. 7 and 8) includes a ground stabilizing assembly, 18, which rests on the ground surface when drop hammer assembly 10 is operated. The lower end, 20, of drop weight 12 confronts a, for example, concrete pad and breaks it up into chunks when drop weight 12 is reciprocating dropped onto the concrete pad. When drop weight 12 breaks up a concrete pad into chunks of concrete and thereafter the operator continues to impact the same broken up area with drop weight 12, a hole soon will develop and drop weight 12 may only impact air. At that time, drop weight end 20 can be laterally displaced into contact with the ground surface end of frame assembly 14. In order to protect frame assembly 14, a shock-absorbing element, 22, is affixed to frame assembly 14. Shock absorbing element 22 is further depicted in FIGS. 3 and 4 and may be, for example, annular in shape with an aperture, 24, accommodating drop weight 12. Shock absorbing element 22 can be made from a variety of elastomeric materials, including, for example, polyurethane, EPDM (ethylene propylene diene monomer), polyvinyl chloride, rubber, or the like. A variety of industrially rugged elastomers are known in the art and are suitable for use herein. The shape of shock absorbing element 22 also is unimportant for its function and can be designed to accommodate the other elements with which it functions.

Frame assembly 14 also has a host transport apparatus engagement assembly, 26, which can be secured by a transport apparatus, such as moveable arms for lifting, moving, and operating drop hammer assembly 10. Power assembly 16 can use hydraulic, pneumatic, electric, or other power for moving its endless chain assembly and reciprocatingly move drop weight 12 vertically up and down. Such power can be self-contained or can hook up to the host transport apparatus for accepting its power (e.g., hydraulic) via a line attachment. Such parasitic power for attachments is quite common and well known in the art. Other power assembly configurations for operating drop weight 12 also can be used as is necessary, desirable, or convenient. Also, other assemblies can be substituted for the endless chain assembly for reciprocatingly moving drop weight 12, as those skilled in this art will appreciate.

Figure 5:
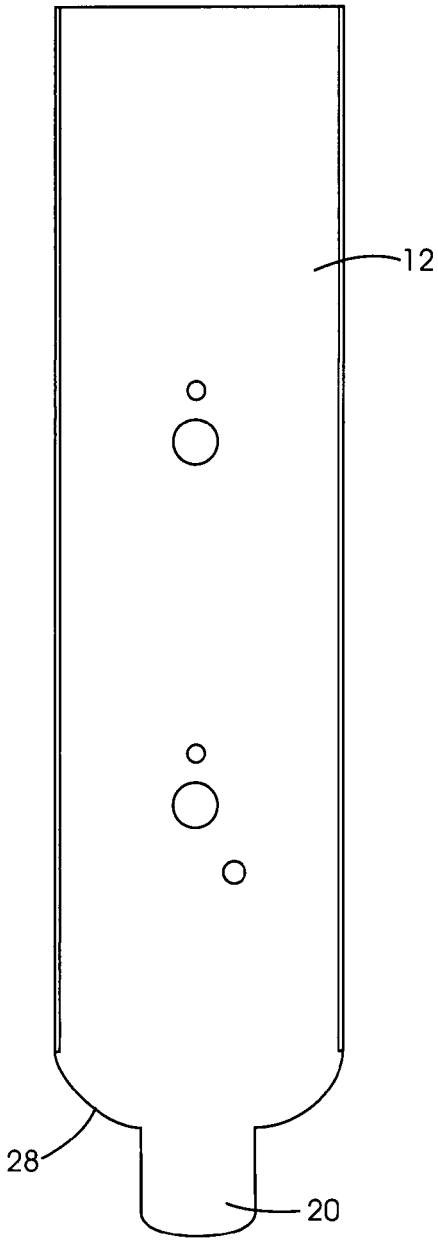
FIG. 5 is a front elevational view of the drop weight.
Figure 6:
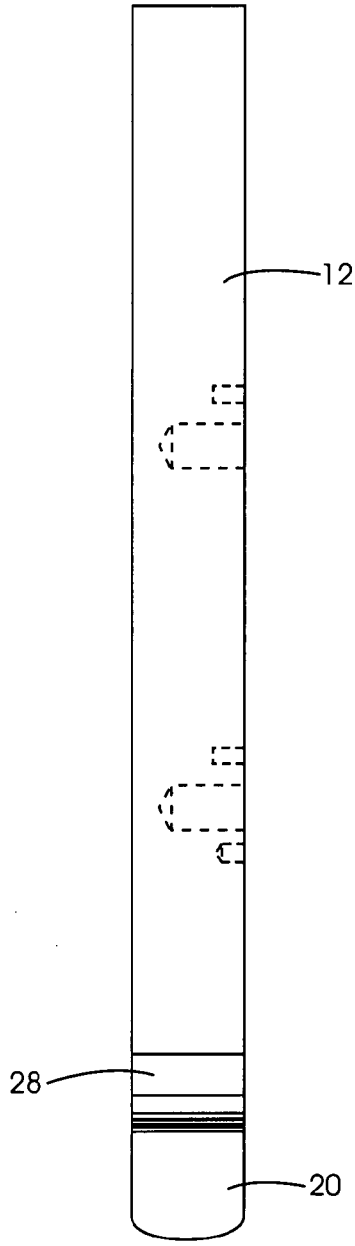
FIG. 6 is a side elevational view of the drop weight of FIG. 5.

Referring now to FIGS. 5 and 6, drop weight 12 can have a narrower lower ground-confronting end, as illustrated, or can be of uniform width its entire extent. Additionally, lower drop weight end 20 can have a rounded end of the same or different material. The drop hammer assembly design illustrated in the drawings runs the risk of inadvertent contact with frame assembly 14 about the location where it tapers. Thus, a shock absorbing element, 28, also can be attached at such location to drop weight 12.

While the apparatus has been described with reference to various embodiments, those skilled in the art will understand that various changes may be made and equivalents may be substituted for elements thereof without departing from the scope and essence of the apparatus. In addition, many modifications may be made to adapt a particular situation or material to the teachings of the disclosure without departing from the essential scope thereof. Therefore, it is intended that the disclosure not be limited to the particular embodiments disclosed, but that the apparatus disclosed will include all embodiments falling within the scope of the appended claims. Also, all citations referred herein are expressly incorporated herein by reference.

I claim:

1. An improved portable, ground stabilized, drop hammer assembly for impacting a ground surface and adapted to be removably coupled to a driven host transport apparatus and comprising a drop weight, a frame assembly including a sidewall, a bottom plate, a host transport apparatus engagement assembly, and a power assembly for vertically reciprocatingly moving said drop weight from an upper position within said frame assembly through an opening in said bottom plate and then downward to impact said ground surface, the improvement comprising:

a shock absorbing elastomeric element carried by said frame assembly close to said ground surface and extending from against the sidewall of the frame assembly and substantially along said bottom plate to about the opening for the drop weight such that any lateral deflection of said drop weight as is moves downward will strike said shock absorbing elastomeric element to protect said frame assembly or said shock absorbing elastomeric element carried by said drop weight at its end close to the ground and when said drop weight is in its lowermost position said shock absorbing elastomeric element extends from against the sidewall of the frame assembly and substantially along said bottom plate to about the opening for the drop weight such that any lateral deflection of said drop weight as it moves downward will result in said shock absorbing elastomeric element striking said frame assembly, wherein any lateral movement by said drop weight into said frame assembly close to the ground surface will be absorbed by said shock absorbing elastomeric element to prevent damage to the frame assembly.

2. The improved drop hammer assembly of claim 1, wherein said shock absorbing elastomeric element is carried by said frame assembly.

3. The improved drop hammer assembly of claim 1, wherein said shock absorbing elastomeric element is carried by said drop weight.

4. The improved drop hammer assembly of claim 3, wherein said shock absorbing element is annular in shape to accommodate said drop weight passing therethrough.

5. The improved drop hammer assembly of claim 1, wherein said frame assembly supports said drop weight, and said power assembly.

6. The improved drop hammer assembly of claim 5, wherein said frame assembly is engaged to said driven host transport apparatus and from which power for said power assembly is taken.

7. The improved drop hammer assembly of claim 1, wherein said power assembly comprises a hydraulic motor.

8. The improved drop hammer assembly of claim 1, wherein said shock absorbing elastomeric element is formed from polyurethane, ethylene propylene diene monomer, polyvinyl chloride, or a rubber.

9. A method for stabilizing a drop weight of a portable, ground stabilized, drop hammer assembly which impacts a ground surface and is adapted to be removably coupled to a driven host transport apparatus and which comprises said drop weight, a frame assembly including a sidewall, a bottom plate, a host transport apparatus engagement assembly, and a power assembly for vertically reciprocatingly moving said drop weight from an upper position within said frame assembly through an opening in said bottom plate and then downward to impact said ground surface, which comprises: affixing said shock absorbing elastomeric element to said frame assembly close to said ground surface and extending from against the sidewall of the frame assembly and substantially along said bottom plate to about the opening for the drop weight such that any lateral deflection of said drop weight as is moves downward will strike said shock absorbing elastomeric element to protect said frame assembly or affixing said shock absorbing elastomeric element to said drop weight at its end close to the ground and when said drop weight is in its lowermost position, said shock absorbing elastomeric element extends from against the sidewall of the frame assembly and substantially along said bottom plate to about the opening for the drop weight such that any lateral deflection of said drop weight as is moves downward will result in said shock absorbing elastomeric element striking said frame assembly, whereby any lateral movement by said drop weight into said frame assembly close to the ground surface will be absorbed by said shock absorbing elastomeric element to prevent damage to the frame assembly.

10. The method of claim 9, wherein said shock absorbing elastomeric element is carried by said frame assembly.

11. The method of claim 9, wherein said shock absorbing elastomeric element is carried by said drop weight.

12. The method of claim 11, wherein shock absorbing elastomeric element is formed from polyurethane, ethylene propylene diene monomer, polyvinyl chloride, or a rubber.

13. The method of claim 9, wherein said frame assembly supports said drop weight, and said power assembly.

14. The method of claim 13, wherein said frame assembly is engaged to said driven host transport apparatus and from which power for said power assembly is taken.

15. The method of claim 9, wherein said power assembly comprises a hydraulic motor.

16. The method of claim 9, wherein said shock absorbing elastomeric element is annular in shape to accommodate said drop weight passing therethrough.

17. An improved portable, ground stabilized, drop hammer assembly for impacting a ground surface and adapted to be removably coupled to a driven host transport apparatus and comprising a drop weight, a frame assembly including a sidewall, a bottom plate, a host transport apparatus engagement assembly, and a power assembly for vertically reciprocatingly moving said drop weight from an upper position within said frame assembly through an opening in said bottom plate and then downward to impact said ground surface, the improvement comprising:

a shock absorbing elastomeric element carried by said frame assembly close to said ground surface and extending from against the sidewall of the frame assembly and substantially along said bottom plate to about the opening for the drop weight such that any lateral deflection of said drop weight as is moves downward will strike said shock absorbing elastomeric element to protect said frame assembly, wherein any lateral movement by said drop weight into said frame assembly close to the ground surface will be absorbed by said shock absorbing elastomeric element to prevent damage to the frame assembly.

18. The improved drop hammer assembly of claim 17, wherein said frame assembly supports said drop weight, and said power assembly.

19. The improved drop hammer assembly of claim 17, wherein said power assembly comprises a hydraulic motor.

20. The improved drop hammer assembly of claim 17, wherein said shock absorbing element is annular in shape to accommodate said drop weight passing therethrough.

* * * * *